United States Patent [19]

Davern et al.

[11] Patent Number: 4,819,856

[45] Date of Patent: Apr. 11, 1989

[54] METHOD AND APPARATUS FOR INSERTING FASTENERS

[75] Inventors: John W. Davern, North Tonawanda; Frank T. Mazurik, Williamsville, both of N.Y.

[73] Assignee: Gemcor Engineering Corp., Buffalo, N.Y.

[21] Appl. No.: 220,407

[22] Filed: Jun. 28, 1988

Related U.S. Application Data

[63] Continuation of Ser. No. 947,851, Dec. 30, 1986, abandoned.

[51] Int. Cl.[4] ..... B25C 7/00

[52] U.S. Cl. ..... 227/119; 227/149

[58] Field of Search ..... 227/26, 119, 114, 147, 227/149, 107; 72/391

[56] References Cited

U.S. PATENT DOCUMENTS

| | | | |
|---|---|---|---|
| 418,696 | 1/1890 | Dean | 227/139 |
| 2,244,595 | 6/1941 | Amiot | 227/139 |
| 2,397,872 | 4/1946 | Kovacs | 227/149 |
| 2,901,749 | 9/1959 | Crossen et al. | 227/149 |
| 3,913,815 | 10/1975 | Holzer | 227/149 |
| 4,515,302 | 5/1985 | Davern et al. | 227/58 |
| 4,577,794 | 3/1986 | Armstrong et al. | 227/119 |

*Primary Examiner*—Frank T. Yost
*Assistant Examiner*—James L. Wolfe
*Attorney, Agent, or Firm*—Christel, Bean & Linihan

[57] ABSTRACT

Method and apparatus for inserting fasteners into holes in a workpiece. The apparatus includes a finger carrying device which is carried by an anvil for telescoping movement relative to the anvil, the finger carrying device includes a bore coaxial with the anvil and through which the anvil may pass as it moves from a raised position to a lowered position. The finger carrying device is provided with a side port through which fasteners may be inserted by a gravity injector, the side port being disposed below the anvil when it is in its raised position. A plurality of annular arrays of resilient fingers are mounted in the bore below the side port. A fastener, after being injected into the bore of the finger carrying device, is pushed by the anvil through the fingers as the anvil moves to its lowered position, the annular arrays of resilient fingers properly orienting the fastener in coaxial alignment with the anvil and with a hole in a workpiece.

9 Claims, 3 Drawing Sheets

Fig. 3.
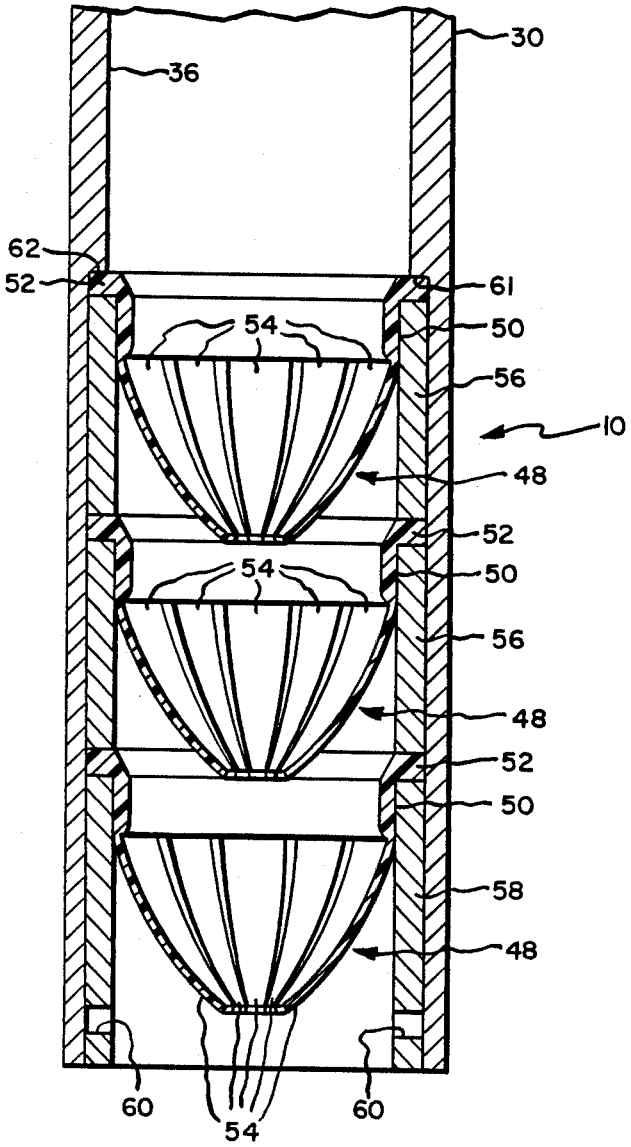
Fig. 4.
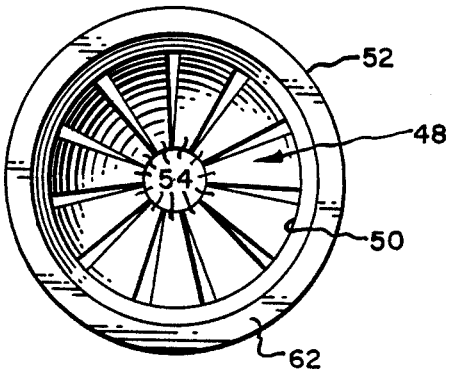
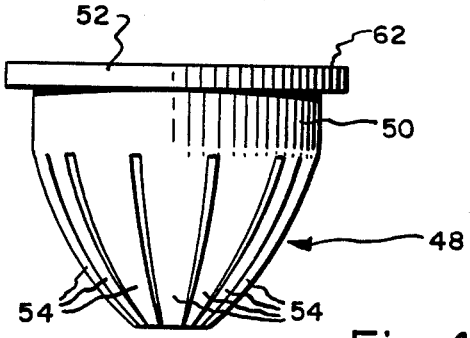
Fig. 4a.
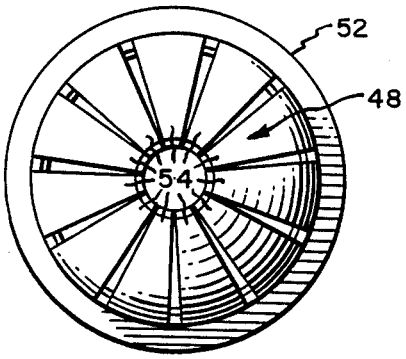
Fig. 4b.

METHOD AND APPARATUS FOR INSERTING FASTENERS

This application is a continuation, of application Ser. No. 947,851, filed Dec. 30, 1986 abandonded.

TECHNICAL FIELD

The present invention relates generally to a method and apparatus for inserting fasteners into a hole in a workpiece.

BACKGROUND OF THE INVENTION

Prior art automatic fastening machines are well known in the art and one such example is U.S. Pat. No. 4,515,302 issued May 7, 1985 which discloses a device for receiving, transferring and inserting a rivet into a hole in a workpiece. The foregoing machine utilizes rivet grasping fingers for holding a rivet and moving it into an inserted position in a hole drilled in the workpiece. It is also necessary to provide means for transferring each rivet in proper alignment to the rivet grasping fingers. The rivet grasping fingers are rigid and must be opened before the rivet can be finally assembled to the workpiece.

While the above prior art design and other similar prior art designs perform in a satisfactory manner, they have several disadvantages. Thus, it is not always possible to insert fasteners close to vertical obstructions, into close corners, and into deep holes or pockets. In addition, the grasping fingers cannot be easily and quickly replaced. Also, it may be necessary to replace the grasping fingers when fasteners of differing sizes are to be installed. Furthermore, when using slug fasteners, it is sometimes difficult to achieve proper orientation of the slug prior to insertion. In addition, it is necessary to utilize a precision mechanical injector for positioning the fasteners so that they can be grasped by the fingers.

OBJECTS AND SUMMARY OF THE INVENTION

It is an object of the present invention to provide a novel method and apparatus for inserting fasteners into holes in a workpiece.

More particularly, it is an object of the present invention to provide a novel device which can receive individual fasteners from a gravity injector, properly coaxially align the fasteners prior to insertion and facilitate the insertion into the hole of a workpiece.

It is also an object of the present invention to provide a compact design which permits the insertion of fasteners close to vertical obstructions, into close corners, and into deep holes or pockets.

It is a further object of the present invention to provide plastic type fingers which are inexpensive, disposable and can be easily and quickly replaced.

It is a further object of the present invention to provide standardization of component parts which will simplify manufacture and reduce parts inventory.

It is a further object of the present invention to provide a design which will handle several types of fasteners including, but not limited to, slugs, index head, countersunk head, and protruding head rivets, and pins for two piece fasteners.

It is a further object of the present invention to provide a design wherein the fastener grasping fingers hold the fastener sufficiently and in such a manner that quick lateral and/or axial movements encountered in transferring the fasteners will not cause the fastener to be lost or misaligned.

The above objects and additional objects of the present invention are accomplished by providing carrier means or finger carrying means which are carried by an anvil for telescoping movement relative to the anvil, the finger carrying means including a bore coaxial with the anvil and through which the anvil may pass as it moves from a raised position to a lowered position, the finger carrying means being provided with a side part through which fasteners may be inserted by a gravity injector, the side part being disposed below the anvil when it is in its raised position, and a plurality of fastener engaging means or annular arrays of resilient fingers mounted in the bore below the port through which the fastener is pushed by the anvil as it moves to its lowered position, the annular arrays of resilient fingers properly orienting the fastener in coaxial alignment with the anvil.

The foregoing objects and other objects and advantages of the present invention will become more apparent after a consideration of the following detailed description taken in conjunction with the accompanying drawings in which a preferred form of this invention is illustrated.

BRIEF DESCRIPTION OF THE DRAWINGS

FIG. 3 is a further enlarged sectional view of a portion of the structure shown in FIG. 2.

FIG. 4 is a top view of one of the annular arrays of resilient fingers.

FIGS. 4*a* and 4*b* are side elevational and bottom views, respectively, of the structure shown in FIG. 4.

DETAILED DESCRIPTION OF A PREFERRED EMBODIMENT

Figure 1:
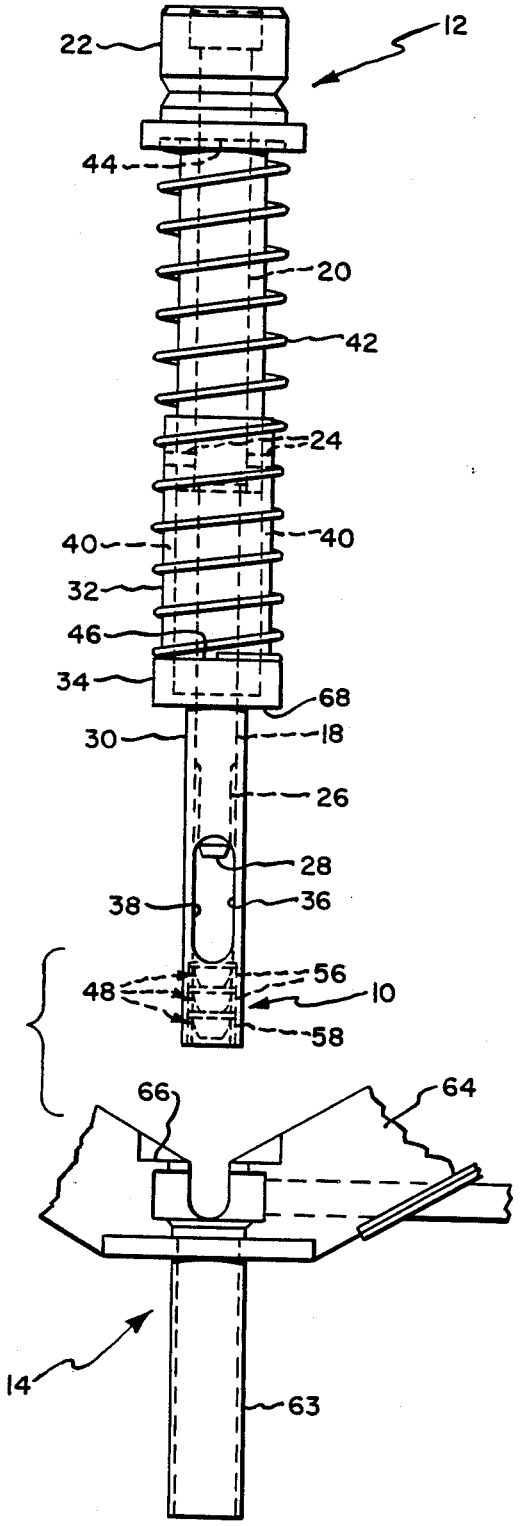
FIG. 1 is a side view of an anvil, finger carrying means and a pressure foot, showing the relationship between the parts when the anvil is in its raised position.
Figure 5:
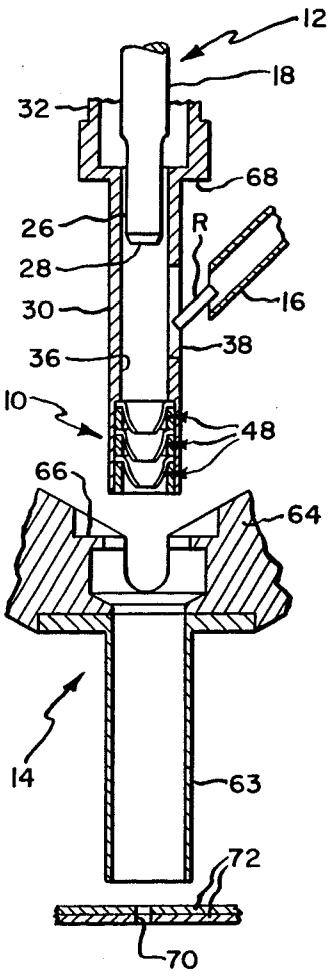
FIG. 5 is a view somewhat similar to FIG. 1 showing the manner in which a fastener is introduced into the finger carrying means.
Figure 9:
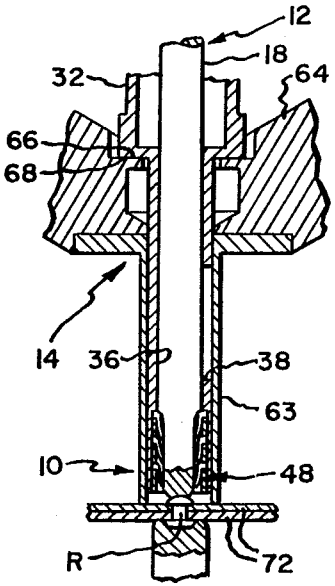
FIG. 9 is a view similar to FIG. 8 but showing the anvil when the fastener is assembled to the workpiece.

The various components of this invention are shown in FIGS. 1 and 5. These components may be supported by a riveting machine, such as the one shown in U.S. Pat. No. 4,515,302, the subject matter of which s incorporated herein by reference thereto. Thus, in accordance with this invention, the carrier means or finger carrying means is indicated generally at 10 and is supported for telescoping movement on an anvil indicated generally at 12. The anvil in turn may be supported by a riveting machine in a conventional manner. The anvil is movable from a first upper position spaced away from the workpiece, the first position being shown in FIG. 1, to a fully lowered position, this position being shown in FIG. 9. A pressure foot, indicated generally at 14 and an injector 16 may also be supported by a riveting machine. The injector may be a simple gravity type drop tube which simply drops individual fasteners into the finger carrying means as required. As will become more apparent from the following, it is not necessary that the fastener be introduced into the finger carrying means with any precision as the finger carrying means will properly orient the fastener during operation.

Figure 2:
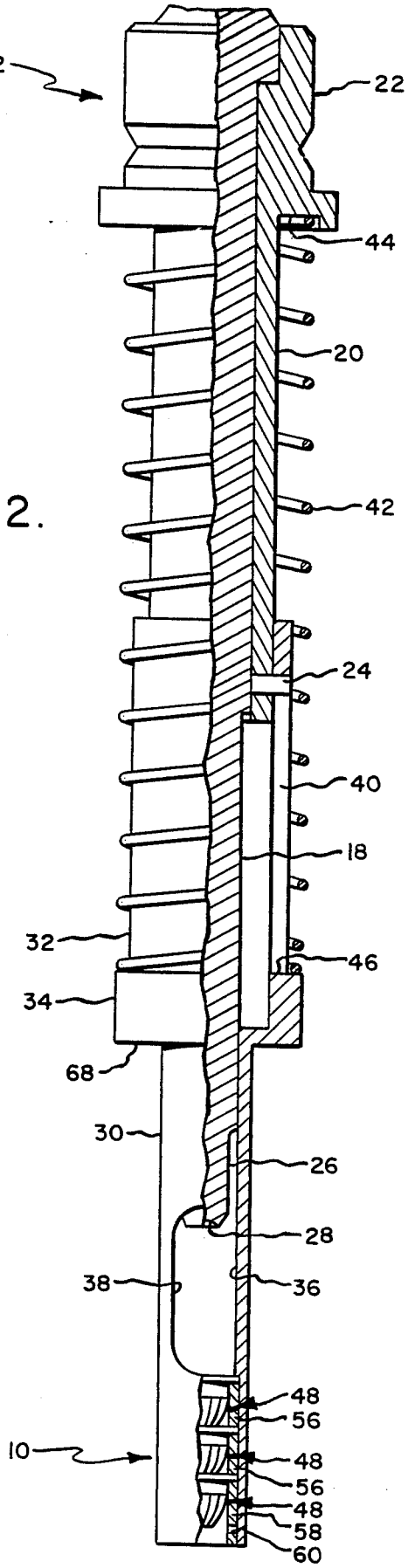
FIG. 2 is an enlarged detail view, partially in section, showing the anvil and finger carrying means, this view also partially showing a plurality of annular arrays of resilient fingers carried by the finger carrying means.

The anvil includes a lower cylindrical portion 18, an upper cylindrical portion 20 and a mounting structure 22 at the upper end of the upper cylindrical portion 20. The anvil may be a one piece construction or it may be a two piece construction as shown in the drawing. The upper cylindrical portion is provided with aligned transverse bores (only being shown in FIG. 2) which will receive cylindrical pins 24 when assembled to the finger carrying means 10, the cylindrical pins 24 being press fit into the transverse bores. The lower cylindrical portion 18 of the anvil may be provided with a further reduced diameter section 26. The lower end of the lower cylindrical portion, which may be the lower end of the reduced diameter section 26, is provided with a fastener contacting face 28, which may be in the form of a removable button or the like.

The finger carrying means in the illustrated embodiment is an integral member having a lower cylindrical sleeve portion 30, an upper sleeve 32 and an intermediate cylindrical abutment portion 34. The lower portion 30, the upper portion 32 and the abutment portion 34 are all provided with a bore 36 which extends from one end of the finger carrying means to the other end. The lower portion 30 is also provided with side port 38 through which a fastener R may be inserted from the injector 16 when the parts are in the position shown in FIG. 5, the illustrated fastener being a slug. The diameter of the bore 36 and the lower sleeve 30 is just slightly greater than the diameter of the lower cylindrical portion 18 of the anvil to provide support for the finger carrying means. Similarly, the bore in the upper sleeve 32 is just slightly greater than the diameter of the upper cylindrical portion 20 to also provide support for the finger carrying means. The upper sleeve 32 is provided with diametrically opposed elongated slots 40 which receive one end of the cylindrical pin 24. Disposed about the upper sleeve 32 and the lower and upper cylindrical portions 18, 20 of the anvil is a compression spring 42. One end of the compression spring bears against the lower face 44 (which may be recessed) of the mounting structure 22 and the other end of the spring 42 bears against the annular surface 46 of the abutment portion 34. When the lower end of the lower sleeve 30 is spaced away from the pressure foot 16 as shown in FIG. 1, the anvil and finger carrying means will be in the position shown in FIG. 2 with the pin 24 engaging the upper end of the slots 40. However, it should be appreciated that if upward axial force were applied to the finger carrying means, the finger carrying means could telescope relative to the anvil.

The lower end of the bore 36 within the lower sleeve 30 is provided with an enlarged diameter portion for the reception of a plurality of fastener engaging means, hereinafter referred to as annular arrays of resilient fingers. Each annular array of resilient fingers, which is indicated generally at 48, includes an annular cylindrical collar element 50, an outwardly extending flange 52 integral with the upper end of the cylindrical collar element 50, and a plurality of fingers 54 integral with the lower edge of the collar element 50, the fingers extending radially inwardly and downwardly when mounted within the lower sleeve 30. Each array is made of a resilient material which could be plastic, nylon, or other spring material, the initial embodiments being formed of nylon. In the initial embodiment, 11 fingers are provided which are spaced apart 32 degrees 44 minutes. Each finger is tapered somewhat, the upper thickness being approximately 0.025 inches and the bottom thickness being approximately 0.018 inches.

Typically, two to five annular arrays of resilient fingers will be mounted within the enlarged portion of the bore in the lower sleeve and this is done simply by inserting the top array, then inserting a spacer 56, inserting the next array, and, if additional arrays are to be employed, providing an additional spacer for each additional array. The final array of resilient fingers is secured in place by means of retaining means 58 which could be a relatively rigid sleeve like member which is press fit into the lower end of the lower sleeve 30. The retaining means may be provided with two or more radially extending holes 60 which can be engaged by a spanner wrench to permit the withdrawal of the retaining means 58 from the lower end of the lower sleeve 30. As is best shown in FIG. 3, the lower end of bore 36 is enlarged slightly to provide a shoulder 61 against which the top surface 62 of the flange 52 of the top array 48 may bear when inserted into the sleeve portion 30.

The pressure foot 14 includes a pressure foot bushing 63 which is adapted to bear against the workpiece, the bushing having an internal diameter sufficiently large that it may receive the lower sleeve 30. The supporting structure 64 which supports the pressure foot bushing 63 is provided with an upper abutment surface 66 which may be engaged by the lower annular surface 68 of the abutment portion 34 when the anvil and the finger carrying mans are moved from their raised position towards the lower position, the engagement of the upper abutment surface 66 by the annular surface 68 preventing further downward movement of the finger carrying means and causing it to telescope with respect to the anvil 12.

Figure 6:
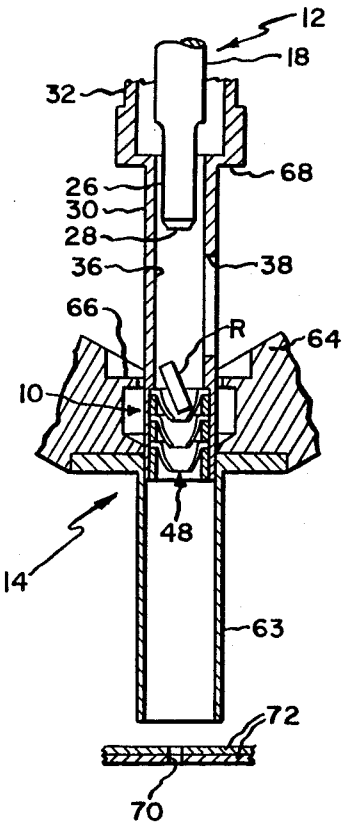
FIG. 6 shows the manner in which the fastener is initially supported by the fingers after insertion.
Figure 7:
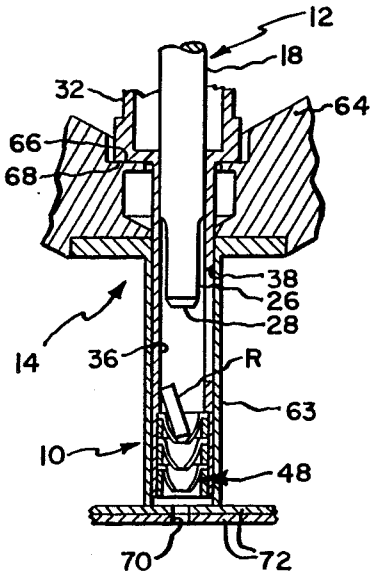
FIG. 7 shows the relationship of the parts after the anvil has moved from the first position towards the second position and the finger carrying means has contacted the pressure foot.
Figure 8:
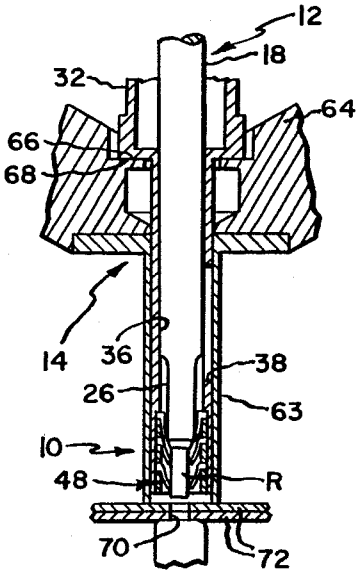
FIG. 8 is a view similar to FIG. 7 but showing the anvil in a further lowered position.

A cycle of operation will now be described. When the anvil is in its fully raised position, shown in either FIG. 1 or FIG. 5, the lower face 28 of the anvil 12 will be disposed above the top of the side port 38. A fastener R may now be fed through the gravity injector 16 and through the side portion 38, the fastener being retained within the lower sleeve 30 (FIG. 6) of the finger carrying structure by the upper annular array of fingers. When the fastener is initially received within the finger carrying means 10, as shown in FIG. 6, it may not be in coaxial alignment with the anvil 12. At this point it should be noted that the parts are so designed that the anvil 12, the finger carrying means 10, and the bushing 63 will all be in coaxial alignment with each other, and additionally that the parts 10, 12 and 63 will be in coaxial alignment with the hole 70 in workpiece 72, which may be two sheets of aluminum that are to be fastened together. As the anvil initially moves downwardly towards the workpiece, it will carry the finger carrying means with it. Thus, the lower sleeve portion 30 of the finger carrying means will initially enter the bushing 63 and then continue through the bushing until the annular surface 68 contacts the upper abutment surface 66 as shown in FIG. 7. Further downward movement of the anvil will continue, and the face 28 of the anvil will contact the fastener and push it progressively through the annular arrays of fingers, the fingers causing the fastener to become coaxially aligned with the hole in the workpiece as well as the anvil 12. At the completion of the downward stroke of the anvil, the fastener will be inserted into the hole in the workpiece. After insertion, the fastener, if a slug or rivet, may be deformed in accordance with well known procedures, such as that shown in U.S. Pat. No. 3,557,442, the subject matter of which is incorporated herein, by reference thereto.

While a slug fastener has been illustrated in the drawings, it should be appreciated that other types of fasteners may also be utilized within this invention, such other types of fasteners including, but not being limited to, index head rivets, countersunk head rivets, protruding head rivets, and pins for two piece fasteners.

While a preferred structure in which the principles of this invention have been incorporated is shown and described above, it is to be understood that the invention is not to be limited to the particular details shown and described above, but that, if fact, widely differing means may be employed in the practice of the broader aspects of this invention.

What is claimed is:

1. A device for receiving, transferring and inserting fasteners into a hole in workpiece; said device comprising:

an anvil having a face movable from a first upper position spaced away from a workpiece to a second lower position spaced closely adjacent said workpiece;

carrier means including a bore extending through said carrier means, said bore being coaxial with the anvil, the face of the anvil passing through the bore as it moves from its first upper position to its second lower position, said carrier means additionally being provided with a side port extending through the carrier means from the bore to its exterior surface and through which a fastener may be fed into the bore when the anvil face is in its upper position; and a plurality of coaxially arranged fastener engaging means entirely mounted within the bore of said carrier means below the side port and one on top of another, each fastener engaging means being formed of a resilient material and including an annular cylindrical collar portion and a plurality of resilient fingers integral with and of the same material as the collar portion, the resilient fingers extending from the collar portion towards the center of the bore and being angled away from the face of said anvil when the anvil is in its first position;

the parts being so arranged and constructed that a fastener initially fed through said port is received on top of the uppermost fastener engaging means and during movement of the anvil from its upper position to its lower position said fastener is transferred from said initial location to an axially oriented location as its sidewalls are engaged by said resilient fingers, the fastener then being inserted into the hole in the workpiece as the anvil completes its movement towards its lower position.

2. A device as set forth in claim 1 further characterized by the provision of feeding means capable of feeding individual fasteners through said side port.

3. A device as set forth in claim 1 further characterized by the provision of a pressure foot, the fastener engaging means and the associated portion of the carrier means being disposed within said pressure foot when said fastener is being inserted into the hole in a workpiece.

4. The device as set forth in claim 1 wherein said annular collar portion and said resilient fingers are formed of a plastic material such as nylon or the like.

5. The device as set forth in claim 1 wherein there are cylindrical spacers between said annular collar portions.

6. The device as set forth in claim 1 wherein the bore in the carrier means is provided with an enlarged diameter portion at its lower end, there being an annular shoulder between the enlarged diameter portion of the bore and the bore immediately above the enlarged diameter portion, the upper surface of the annular collar portion of the uppermost fastener engaging means bearing against the said shoulder.

7. The device as set forth in claim 6 wherein said annular collar portion is retained in place by retaining means force fit into said enlarged diameter portion.

8. An apparatus for inserting a fastener into a hole in a workpiece comprising the following:

a tubular carrier having a side port between its lower discharge end and its upper end, the bore within the tubular carrier being held coaxially with the hole in the workpiece;

a plurality of fastener engaging means mounted coaxially within the bore of the tubular carrier between the side port and the lower discharge end, each of the fastener engaging means including an annular collar portion and a plurality of resilient fingers integral with and of the same material as the collar portion; and an anvil at least a portion of which is disposed within the bore of the carrier between the side port and the upper end, the anvil being in coaxial alignment with the fastener engaging means and being movable from a raised position wherein it is entirely disposed above the side port in the tubular carrier to a lower position where the lower face of the anvil is disposed well below the side port in the tubular carrier.

9. A method of inserting a fastener into a hole in a workpiece comprising the following steps:

providing a tubular carrier having a side port between its discharge end and another end; the tubular carrier being held coaxially with the hole in the workpiece;

mounting a plurality of fastener engaging means coaxially within the bore of the tubular carrier between the side port and the discharge end, each of the fastener engaging means including an annular collar portion and a plurality of resilient fingers integral with the collar portion;

disposing at least a portion of an anvil within the carrier between the side port and the other end, the anvil being held in coaxial alignment with the fastener engaging means;

inserting a fastener through the port in the tubular carrier onto that fastener engaging means which is spaced closest to the port; and moving the anvil towards the workpiece to progressively force the fastener through the fastener engaging means to cause the fastener to initially become coaxially aligned with the hole in the workpiece and then to be inserted into said hole.

* * * * *